US007685837B2

(12) United States Patent
Ritchie et al.

(10) Patent No.: US 7,685,837 B2
(45) Date of Patent: Mar. 30, 2010

(54) FREEZER STORAGE ASSEMBLY FOR A REFRIGERATOR

(75) Inventors: Sheena Leigh Ritchie, Shepherdsville, KY (US); Mark W. Wilson, Simpsonville, KY (US); Arunkumar Pappusamy, Tamil Nadu (IN)

(73) Assignee: General Electric Company, Schenectady, NY (US)

( * ) Notice: Subject to any disclaimer, the term of this patent is extended or adjusted under 35 U.S.C. 154(b) by 547 days.

(21) Appl. No.: 11/646,902

(22) Filed: Dec. 28, 2006

(65) Prior Publication Data

US 2008/0156029 A1 Jul. 3, 2008

(51) Int. Cl.
*F25D 17/04* (2006.01)

(52) U.S. Cl. ..... 62/408; 62/419; 62/440

(58) Field of Classification Search ..... 62/408, 62/419, 186, 187, 440
See application file for complete search history.

(56) References Cited

U.S. PATENT DOCUMENTS 3,169,383 A * 2/1965 Morton et al. ..... 62/414
4,304,101 A * 12/1981 Gidseg ..... 62/187
4,358,932 A * 11/1982 Helfrich, Jr. ..... 62/126
4,368,622 A * 1/1983 Brooks ..... 62/157
5,033,272 A * 7/1991 Yoshikawa et al. ..... 62/199
5,291,752 A * 3/1994 Alvarez et al. ..... 62/344
5,931,011 A * 8/1999 Shima et al. ..... 62/182
6,351,967 B1 * 3/2002 Adachi et al. ..... 62/441
6,401,482 B1 * 6/2002 Lee et al. ..... 62/408
6,675,603 B1 * 1/2004 Lesyna et al. ..... 62/407
6,904,410 B1 6/2005 Weiss et al.
6,968,712 B2 * 11/2005 Wilkinson ..... 62/408
2002/0123957 A1 9/2002 Notarius et al.
2002/0134498 A1 9/2002 Pennino et al.
2004/0085225 A1 5/2004 Wilson
2005/0126185 A1 * 6/2005 Joshi ..... 62/3.6

* cited by examiner

*Primary Examiner*—Melvin Jones
(74) *Attorney, Agent, or Firm*—George L. Rideout, Esq.; Armstrong Teasdale LLP

(57) ABSTRACT

A storage assembly for a refrigerator having a freezer storage compartment includes a second storage compartment positioned within the freezer storage compartment, and a cooling plate positioned within the second storage compartment. The cooling plate is configured to support a food item and transfer thermal energy between the food item and the cooling plate through conduction. The storage assembly also includes a fan positioned at a first end of the second storage compartment. The fan is configured to draw cool air into the second storage compartment and direct the cool air across the food item.

20 Claims, 9 Drawing Sheets

FREEZER STORAGE ASSEMBLY FOR A REFRIGERATOR

BACKGROUND OF THE INVENTION

This invention relates generally to refrigeration appliances and, more particularly, to apparatus and methods for freezing foods within a storage compartment of the refrigeration appliance.

Many conventional household refrigeration appliances include a freezer storage compartment and a fresh food storage compartment, either arranged in a side-by-side configuration and separated by a center mullion wall, or in an over-and-under configuration and separated by a horizontal center mullion wall. A freezer door and a fresh food door close the access openings to the freezer storage compartment and the fresh food storage compartment, respectively.

At least some conventional refrigeration appliances provide a substantially even temperature within the freezer storage compartment. However, it may be desirable to rapidly cool and/or store certain food items at a temperature different than the temperature within the freezer storage compartment to prevent ice crystal growth, which may damage the freshness of the food items. Further, it may be desirable to maintain certain food items, such as meat products, at a soft freeze state (e.g., not completely frozen) for facilitating maintaining the meat products fresh for a relatively longer period of time and/or cutting the meat products.

BRIEF DESCRIPTION OF THE INVENTION

In one aspect, a storage assembly for a refrigerator including a freezer storage compartment is provided. The storage assembly includes a second storage compartment positioned within the freezer storage compartment, and a cooling plate positioned within the second storage compartment and configured to support a food item. The cooling plate is configured to transfer thermal energy between the food item and the cooling plate through conduction. The storage assembly also includes a fan positioned at a first end of the second storage compartment and configured to draw cool air into the second storage compartment and direct the cool air across the food item.

In another aspect, a refrigerator is provided. The refrigerator includes a freezer storage compartment having a first temperature, and a storage assembly mounted within the freezer storage compartment. The storage assembly includes a second storage compartment, a fan positioned at a first end of the second storage compartment and configured to direct cool air into the second storage compartment, and a temperature sensor positioned with respect to the second storage compartment and configured to detect a temperature within the second storage compartment. The refrigerator also includes a controller operatively coupled to the temperature sensor. The controller is configured to maintain a temperature within the second storage compartment at a second temperature independent from the first temperature within the freezer storage compartment.

In another aspect, a method for freezing a food item within a refrigerator is provided. The method includes providing a freezer storage compartment having a first temperature, and positioning a storage assembly within the freezer storage compartment. The storage assembly includes a second storage compartment, a fan configured to direct cool air into the second storage compartment, and a temperature sensor positioned with respect to the second storage compartment, the sensor configured to detect a temperature within the second storage compartment. The method also includes operatively coupling a controller to the temperature sensor, the controller configured to maintain a second temperature within the second storage compartment independent from the first temperature within the freezer storage compartment.

DETAILED DESCRIPTION OF THE INVENTION

Figure 1:
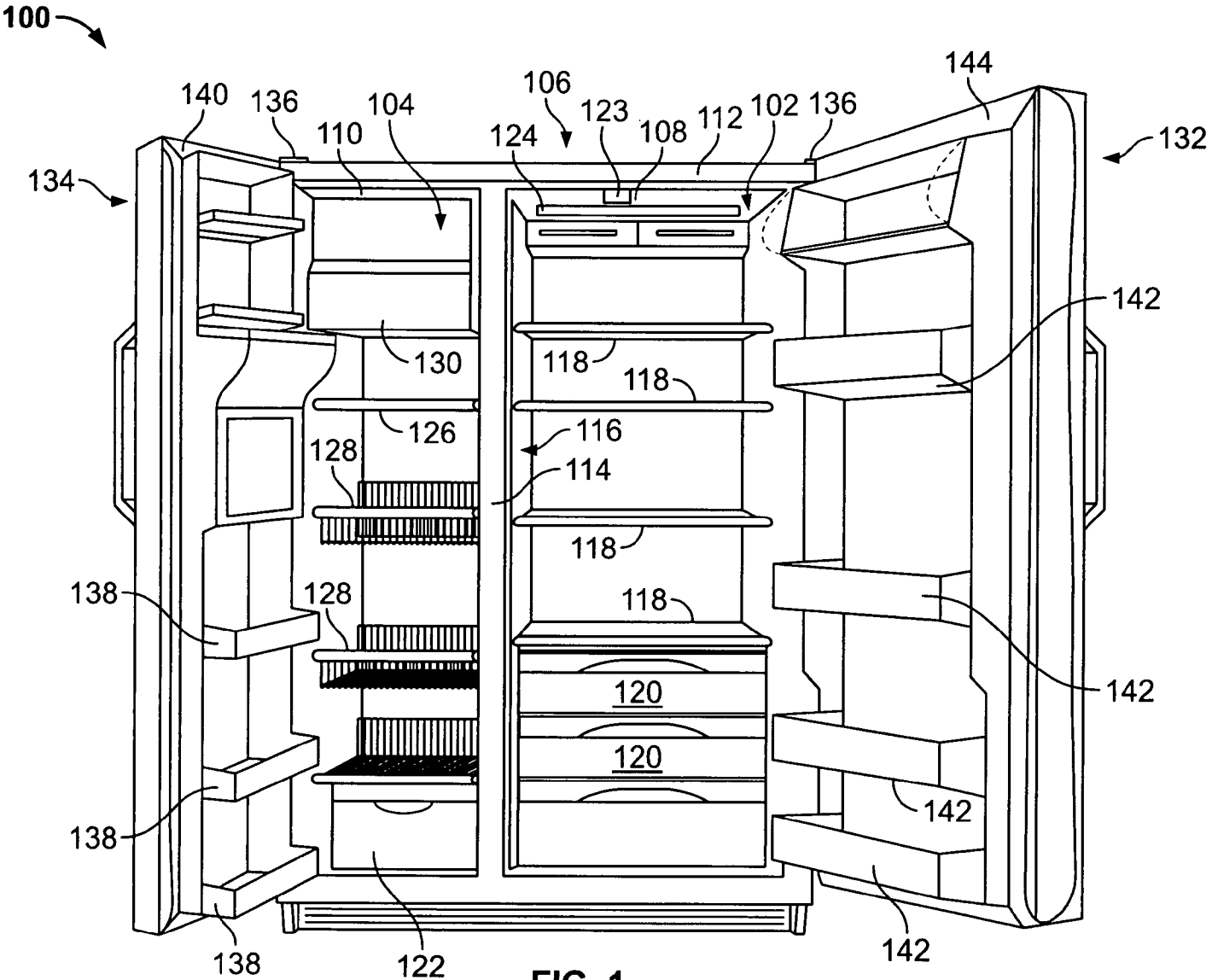
FIG. 1 is a perspective view of an exemplary refrigerator.

FIG. 1 illustrates a side-by-side refrigerator 100 in which exemplary embodiments of the present invention may be practiced and for which the benefits of the invention may be realized. It is recognized, however, that the benefits of the present invention may be achieved in other types of refrigerators, such as for example, over-and-under refrigerators. Therefore, the description set forth herein is for illustrative purposes only and is not intended to limit the invention in any aspect.

Refrigerator 100 includes a fresh food storage compartment 102 and a freezer storage compartment 104 arranged side-by-side and contained within an outer case 106 and inner liners 108 and 110. A space between outer case 106 and inner liners 108 and 110, and between inner liners 108 and 110, is filled with foamed-in-place insulation. Outer case 106 normally is formed by folding a sheet of a suitable material, such as pre-painted steel, into an inverted U-shape to form top and side walls of case. A bottom wall of outer case 106 normally is formed separately and attached to the case side walls and to a bottom frame that provides support for refrigerator 100. Inner liners 108 and 110 are molded from a suitable plastic material to form fresh food storage compartment 102 and freezer storage compartment 104, respectively. Alternatively, inner liners 108, 110 may be formed by bending and welding a sheet of a suitable metal, such as steel. The illustrative embodiment includes two separate inner liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer storage compartment and a fresh food storage compartment.

A breaker strip 112 extends between a case front flange and outer front edges of inner liners 108, 110. Breaker strip 112 is formed from a suitable resilient material, such as an extruded acrylo-butadiene-styrene based material (commonly referred to as ABS).

The insulation in the space between inner liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of outer case 106 and vertically between inner liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food storage compartment 102 to support items being stored therein. A storage assembly 122 is provided in a lower portion of freezer storage compartment 104, and is selectively controlled, together with other refrigerator features, by a controller 123 according to user preference via manipulation of a control interface 124 mounted in an upper region of fresh food storage compartment 102 and coupled to controller 123. In addition, at least one shelf 126 and at least one wire basket 128 are also provided in freezer storage compartment 104. It is contemplated that the position of storage assembly 122, controller 123, and control interface 124 are varied in alternative embodiments.

Controller 123 is mounted within refrigerator 100, and is programmed to perform functions described herein. As used herein, the term controller is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A fresh food door 132 and a freezer door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 134 includes a plurality of storage shelves 138 and a sealing gasket 140, and fresh food door 132 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cool air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
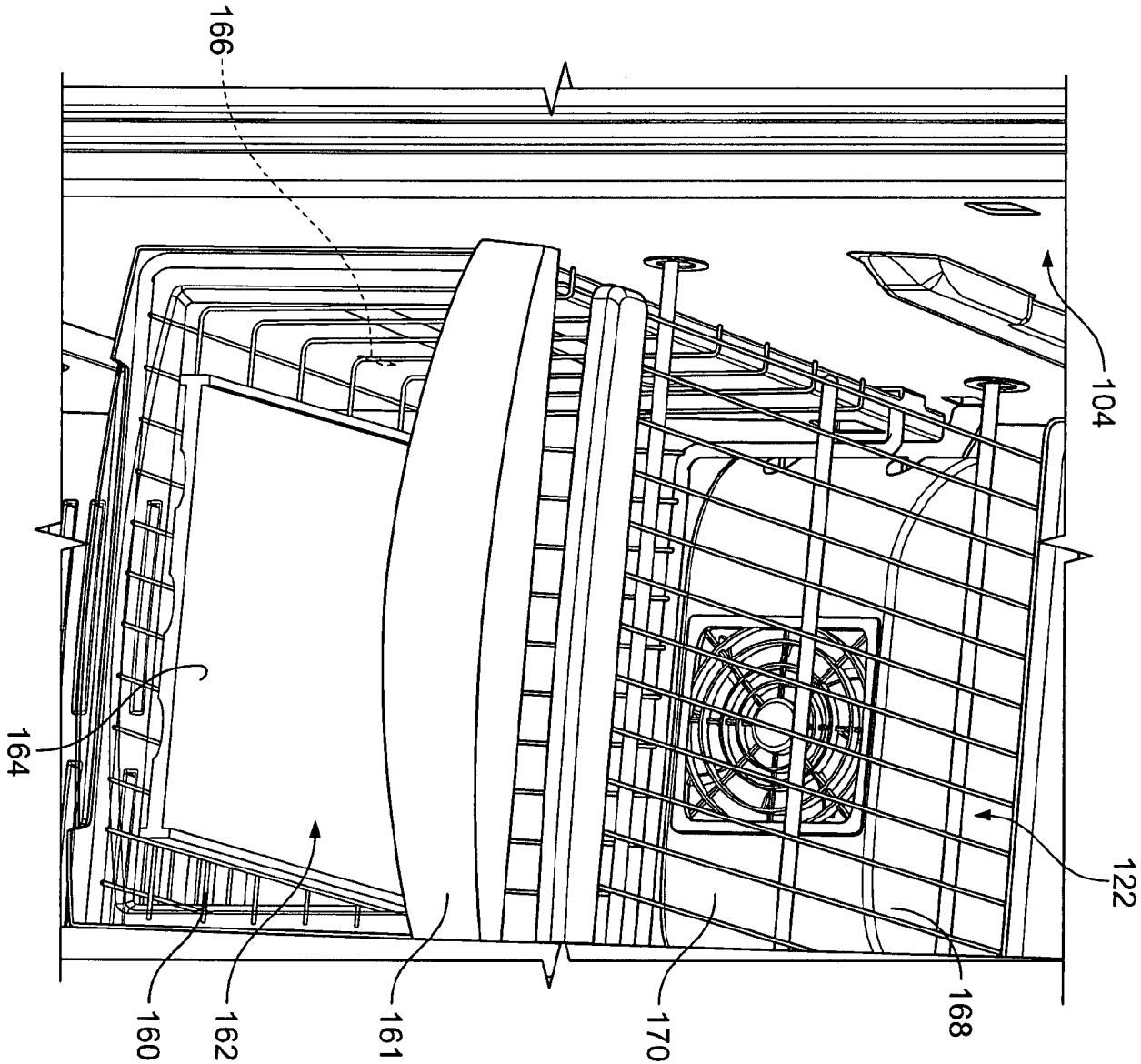
FIG. 2 is a perspective view of an exemplary storage assembly suitable for use with the refrigerator shown in FIG. 1.

FIG. 2 is a perspective view of an exemplary storage assembly 122 suitable for use with refrigerator 100 shown in FIG. 1. Storage assembly 122 includes a wired basket 160, and a transparent front panel 161 coupled to the front side of basket 160 at least partially defining a storage compartment 162. A cooling plate is positioned on a bottom surface of storage compartment 162. In one embodiment, at least one feedback device, such as a temperature sensor 166 or any suitable sensor or detector, is positioned with respect to storage compartment 162 for sensing a temperature within storage compartment 162. A fan assembly 168 is in flow communication with storage compartment 162 to direct air flow through storage compartment 162. Storage compartment 162 is slidably received within freezer storage compartment 104, and defines a top opening 170 for placing food items into and/or retrieving food items from within storage compartment 162. Cooling plate 164 is made of a thermally conductive material, such as a metal material or any suitable material, and is configured to support food items. Temperature sensor 166 is operatively coupled to controller 123 (shown in FIG. 1). In one embodiment, temperature sensor 166 is in signal communication with controller 123 and is configured to receive and/or transmit at least one signal related to a temperature sensed within storage compartment 162. As shown in FIG. 2, fan assembly 168 is positioned at a rear end of storage compartment 162 when storage compartment 162 is positioned within freezer storage compartment 104.

Figure 3:
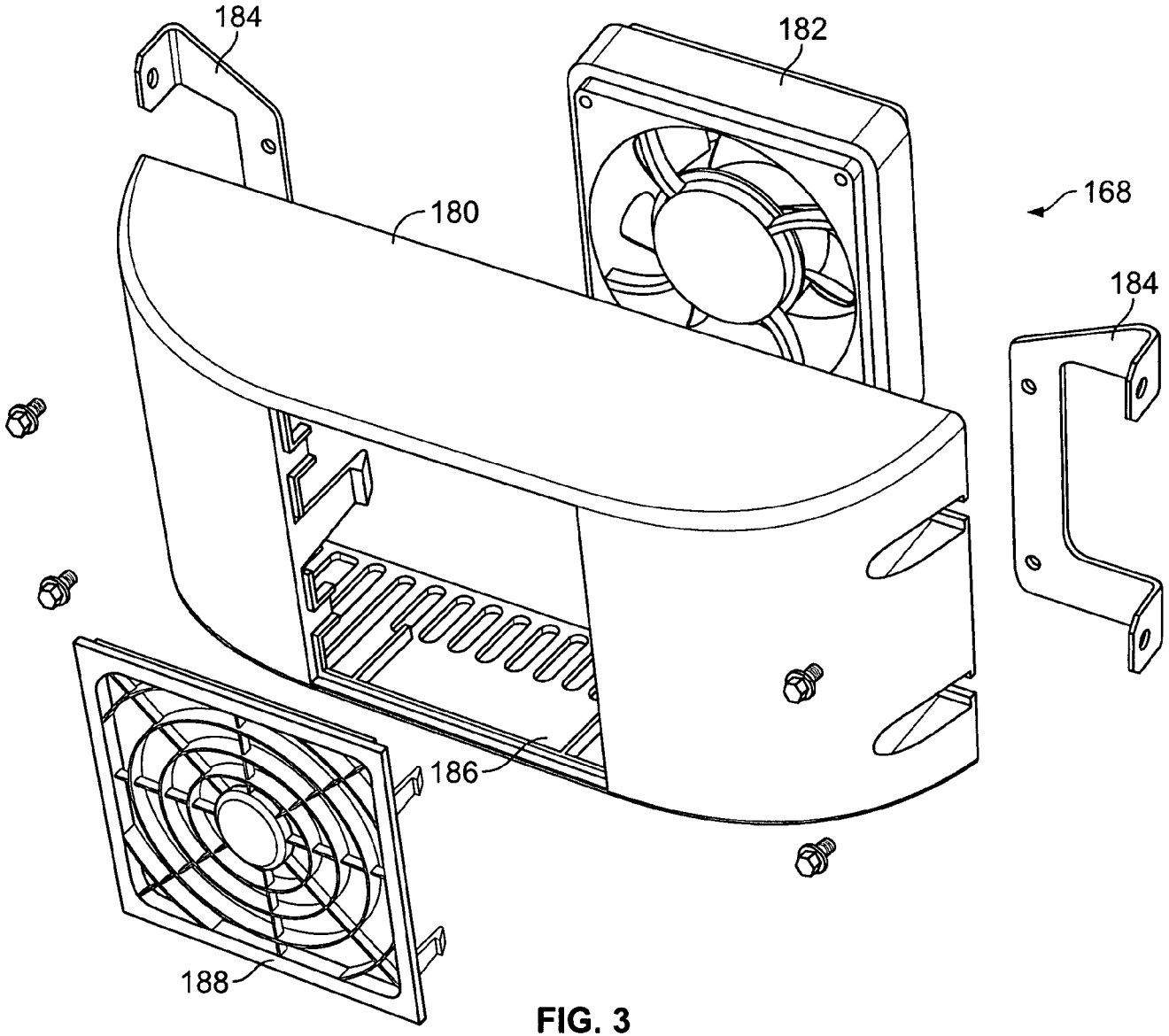
FIG. 3 is an exploded view of an exemplary fan assembly suitable for use with the storage assembly shown in FIG. 2.

FIG. 3 is an exploded view of fan assembly 168 suitable for use with storage assembly 122 shown in FIG. 2. Fan assembly 168 includes a fan housing 180, a fan 182 retained within fan housing 180, and two brackets 184 mounting fan housing 180 within freezer storage compartment 104 (shown in FIG. 1). Fan housing 180 defines a fan housing opening 186 corresponding to the location of fan 182. A fan housing grill 188 covers fan housing opening 186. As such, fan 182 channels or directs cool air through fan housing opening 186, and fan housing grill 188 prevents or limits undesirable contact with fan 182.

In one embodiment, referring to FIG. 2, during a fast cooling mode, fan assembly 168 directs cool air across the food item(s) positioned within storage compartment 162 at an increased velocity compared to a velocity of the air circulating though freezer storage compartment 104. Cooling plate 164 (shown in FIG. 2) also transfers thermal energy between the food item(s) and cooling plate 164 through conduction. As such, the food item(s) is/are cooled at a relatively faster rate through conduction and/or convection. In a particular embodiment, controller 123 (shown in FIG. 1) monitors the temperature within storage compartment 162 through temperature sensor 166 (shown in FIG. 2). Controller 123 energizes or de-energizes fan assembly 168 when the sensed temperature is below or above, respectively, a selected temperature, which may be set and/or adjusted by the user through control interface 124 (shown in FIG. 1). As such, controller 123 maintains a desired temperature within storage compartment 162 independently from a temperature within freezer storage compartment 104. In a particular embodiment, controller 123 maintains storage compartment 162 at a temperature lower than the temperature within freezer storage compartment 104. In an alternative embodiment, controller 123 includes an open loop having a suitable timer to control the operation of fan assembly 168 in a fast cooling mode and/or a soft freeze mode, as described below.

Figure 4:
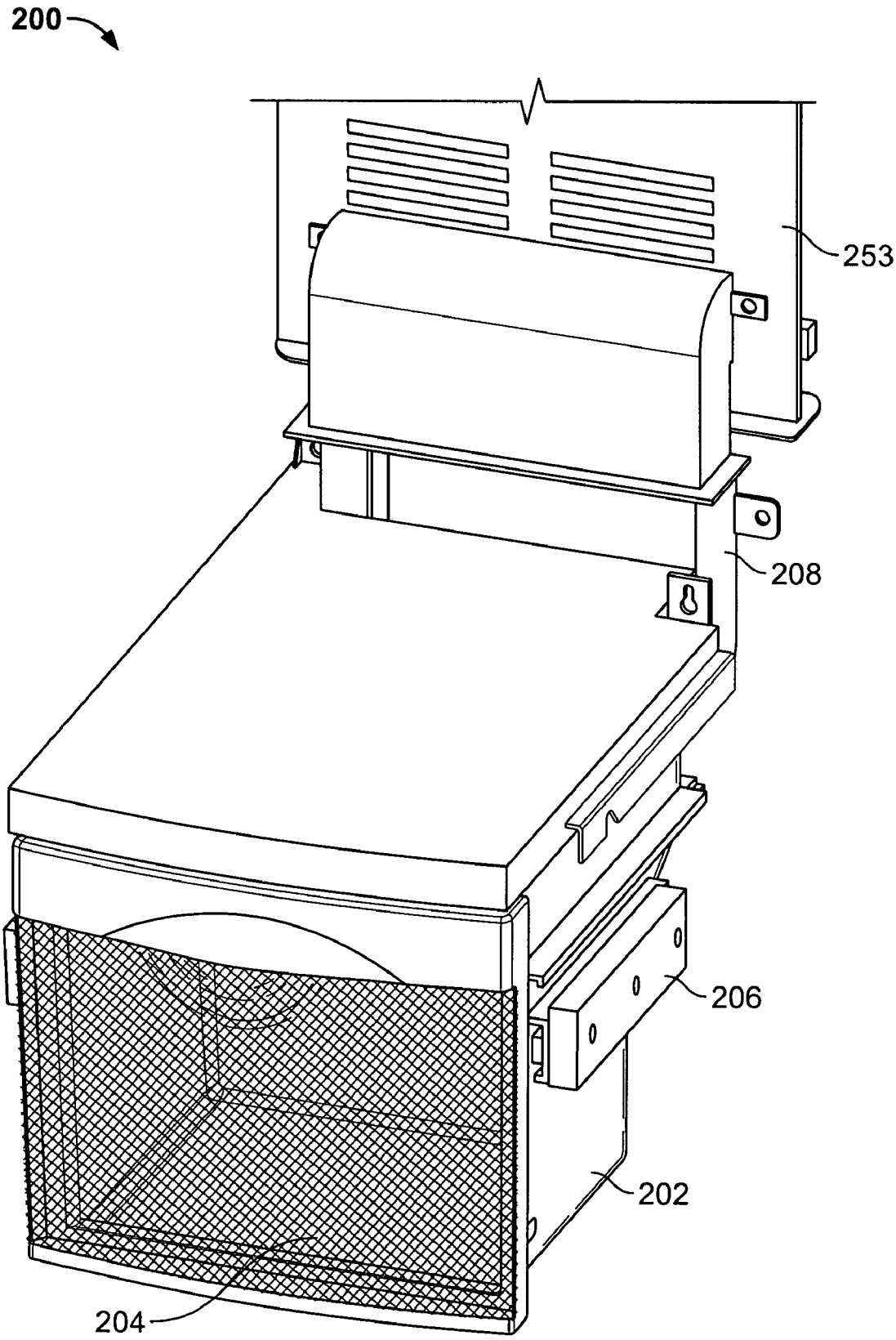
FIG. 4 is a perspective view of an alternative storage assembly suitable for use with the refrigerator shown in FIG. 1.
Figure 5:
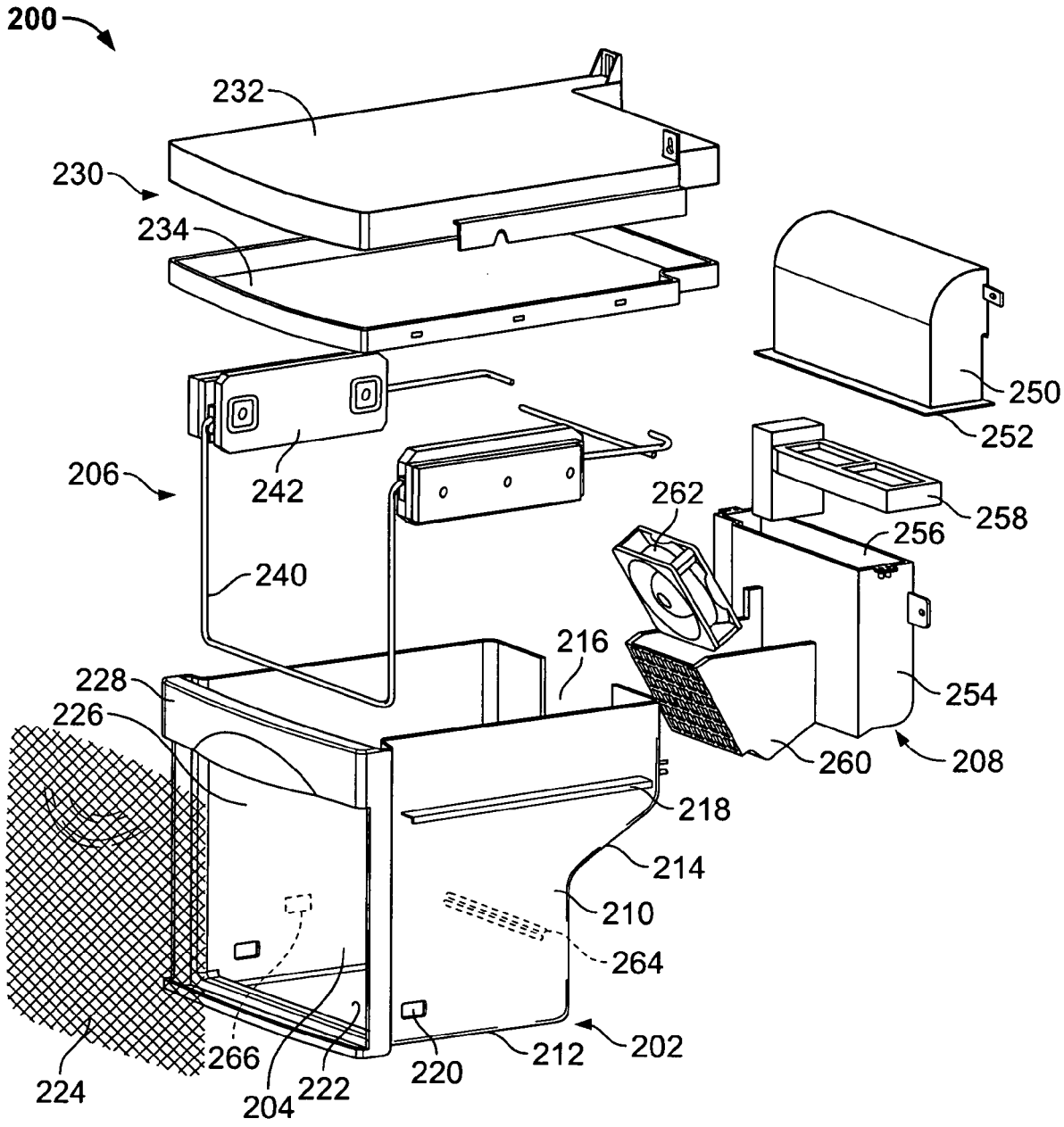
FIG. 5 is an exploded view of the storage assembly shown in FIG. 4.

FIG. 4 is a perspective view of an alternative storage assembly 200 suitable for use with refrigerator 100 shown in FIG. 1. FIG. 5 is an exploded view of storage assembly 200 shown in FIG. 4. Storage assembly 200 includes a basket 202 defining a storage compartment 204. A slide assembly 206 is coupled to an interior wall of freezer storage compartment 104 and configured to support basket 202. An air handler 208 is positioned with respect to storage compartment 204 and configured to control air flow through storage compartment 204.

Basket 202 includes opposite side walls 210, a bottom wall 212 extending between side walls 210, and a rear wall 214 including a cutout portion 216 for receiving a portion of air handler 208. Each side wall 210 includes an outwardly projecting support member 218, and an air vent 220 defined thereon. In one embodiment, basket 202 is made of thermally conductive material, such as a suitable metal material or any suitable material. As such, bottom wall 212 functions as a cooling plate 222 to transfer thermal energy between the food item(s) supported on cooling plate 222 and bottom wall 212. In an alternative embodiment, a metal cooling plate 222 is removably positioned within basket 202.

Basket 202 also includes a front panel 224 covering a front opening 226 of basket 202. In one embodiment, at least a portion of front panel 224 is transparent or semi-transparent. An outwardly curved handle 228 is formed on or coupled to front panel 224 for user manipulation to open and close basket 202. When basket 202 is in a closed position, basket 202 is covered by a stationary cover assembly 230. Cover assembly 230 is coupled to an interior surface of freezer storage compartment 104 (shown in FIG. 2). Referring to FIG. 5, cover assembly 230 includes a first cover 232 and a second cover 234. In one embodiment, first cover 232 and second cover 234 are made of a thermally insulated material. In an alternative embodiment, a thermally insulated material is positioned between first cover 232 and second cover 234. As such, storage compartment 204 is substantially thermally insulated from freezer storage compartment 104 by cover assembly 230, particularly during the operation of a fast cooling mode and/or a soft freeze mode.

Slide assembly 206 facilitates movement of basket 202 within freezer storage compartment 104. Slide assembly 206 includes a wire frame 240 supporting support members 218 of basket 202 thereon, and right and left slides 242 which allow frame 240 to slide with basket 202 within freezer storage compartment 104.

Air handler 208 includes an air handler top 250 defining an upper air channel 252 in flow communication with an air conduit 253 for supplying cool air to air handler 208. Air handler 208 also includes an air handler bottom 254 defining a lower air channel 256. An air damper 258 is positioned within air handler bottom 254 for controlling the air flow between upper air channel 252 and lower air channel 256. Air handler bottom 254 also includes a fan housing 260 formed at a lower portion thereof and projecting into basket 202 when basket 202 is in the closed position, as shown in FIG. 4. A fan 262 is positioned within fan housing 260 for creating or generating an air flow through upper air channel 252 and lower air channel 256, and further through storage compartment 204 when damper 258 is open.

In one embodiment, at least one electrical heater 264 is provided within storage compartment 204. Heater 264 is operatively coupled to controller 123 for heating storage compartment 204 according to user manipulation through control interface 124 (shown in FIG. 1).

In one embodiment, a feedback device, such as a temperature sensor 266, is positioned within storage compartment 204 for sensing the temperature within storage compartment. In one embodiment, temperature sensor 266 includes an air temperature sensor configured to detect an air temperature within storage compartment 204. In an alternative embodiment, temperature sensor 266 includes a contact temperature sensor configured to detect a temperature of a portion of basket 202, such as for example, bottom wall 212 and/or cooling plate 222. Temperature sensor 166 is operatively coupled to controller 123 (shown in FIG. 1). In one embodiment, temperature sensor 166 is in signal communication with controller 123 to receive and/or transmit at least one signal related to the temperature sensed within storage compartment 204. Controller 123 may operate air handler 208 and/or heater 264 based on the signal received from and/or transmitted to temperature sensor 266.

Figure 6:
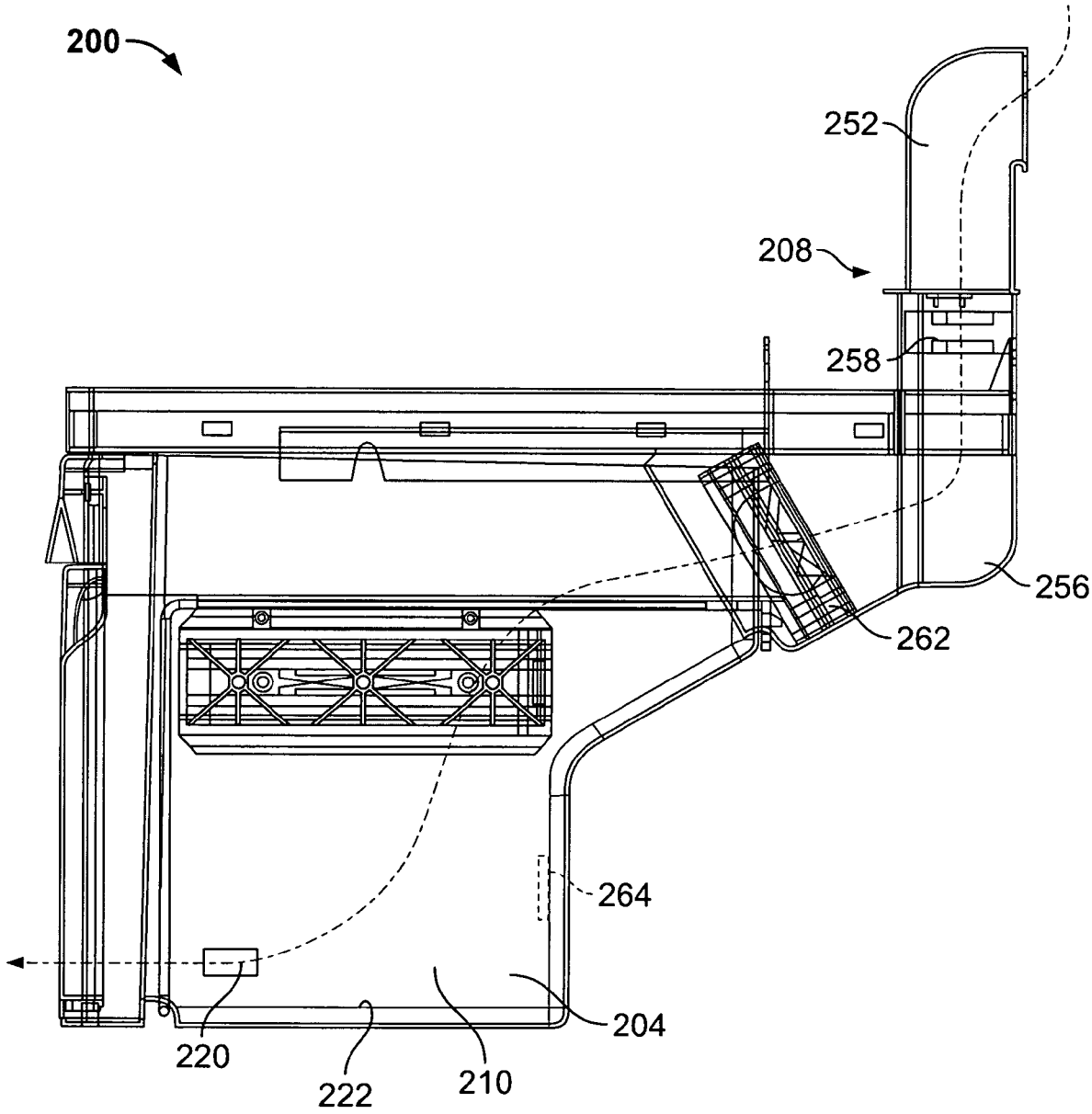
FIG. 6 shows an exemplary air flow path through the storage assembly shown in FIGS. 4 and 5.

FIG. 6 illustrates an exemplary air flow path through storage assembly 200 shown in FIGS. 4 and 5. During a fast cooling mode according to one embodiment, controller 123 opens damper 258 and energizes fan 262 to draw cool air into storage compartment 204. The cool air flows from the evaporator (not shown) through upper air channel 252 and lower air channel 256 of air handler 208 when damper 258 is open, and then into storage compartment 204. In one embodiment, fan 262 directs the cool air into storage compartment 204 at an increased velocity compared with a velocity of the air circulating through freezer storage compartment 104 (shown in FIG. 1). The cool air flows across the food item(s) positioned within storage compartment 204, and exits storage compartment 204 through air vents 220 on both side walls 210. In a particular embodiment, cooling plate 222 is provided to facilitate cooling the food item(s) supported thereon.

Controller 123 de-energizes heater 264 during the fast cooling mode. In one embodiment, controller 123 monitors the temperature within storage compartment 204 through temperature sensor 266. Controller 123 energizes or de-energizes fan 262, and opens or closes damper 258 when the sensed temperature below or above, respectively, a given temperature, which may be set and/or adjusted through control interface 124. As such, controller 123 maintains a temperature within storage compartment 204 independently from a temperature within freezer storage compartment 104 for storing a specific food item, such as meat and/or ice cream, within storage compartment 204.

During a soft freeze mode according to one embodiment, controller 123 closes damper 258, de-energizes fan 262, and energizes heater 264 to heat the air within storage compartment 204. In a particular embodiment, controller 123 maintains storage compartment 204 at a temperature higher than that of freezer storage compartment 104, such as for example, from about 7° F. to about 28° F. Controller 123 energizes or de-energizes heater 264 when the sensed temperature below or above, respectively, a predetermined temperature. As such, controller 123 maintains a temperature within storage compartment 204 independently from a temperature within freezer storage compartment 104.

Figure 7:
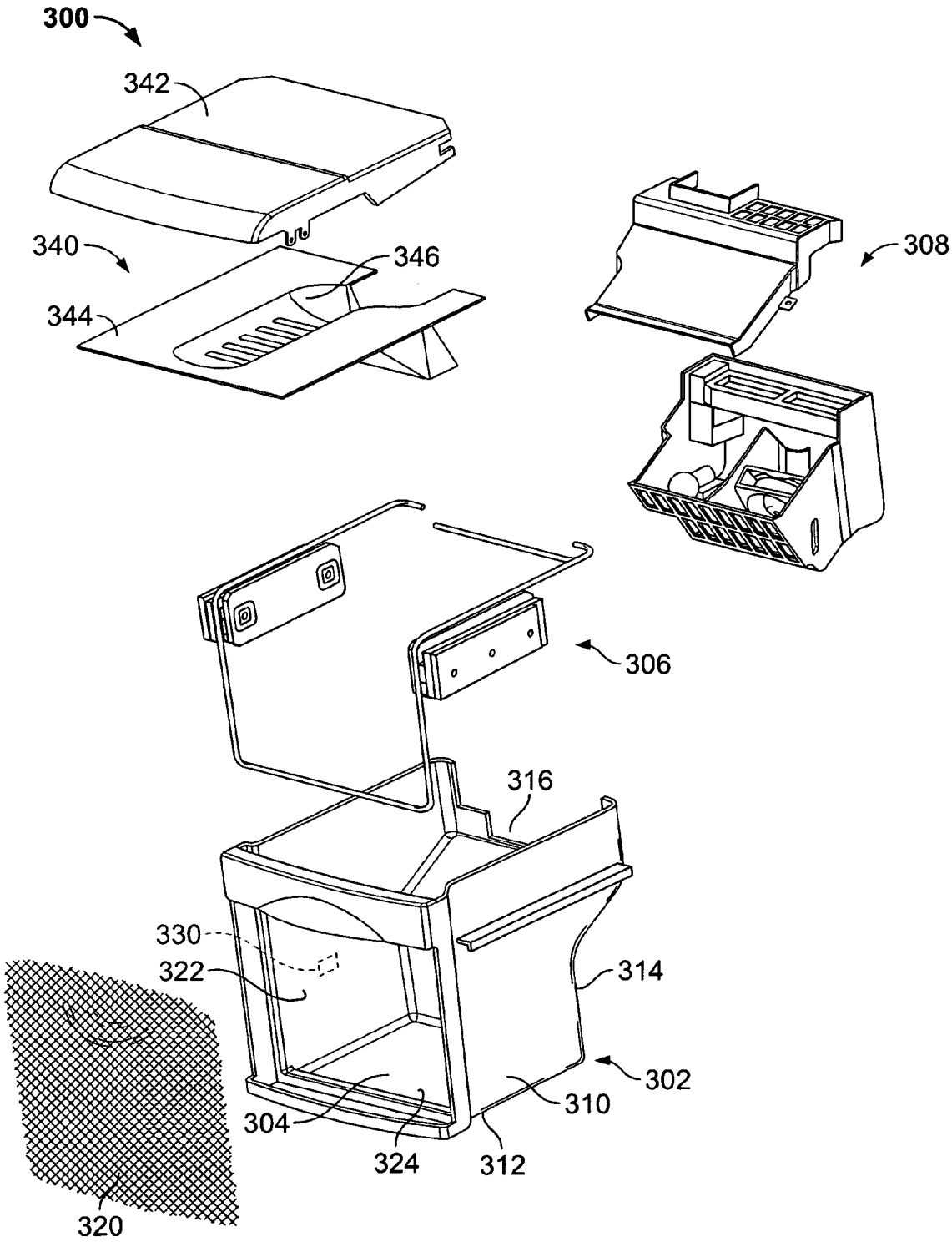
FIG. 7 is an exploded view of an alternative storage assembly suitable for use with the refrigerator shown in FIG. 1.

FIG. 7 is a perspective view of an alternative storage assembly 300 suitable for use with refrigerator 100 shown in FIG. 1. Storage assembly 300 includes a basket 302 defining a storage compartment 304, a slide assembly 306 coupled to an interior surface of freezer storage compartment 104 and configured to support basket 302, and an air handler 308 positioned with respect to storage compartment 304 and configured to control air flow through storage compartment 304.

In one embodiment, basket 302 is similar to basket 202 (shown in FIGS. 4 and 5), and includes opposite side walls 310, a bottom wall 312, a rear wall 314 having a cutout portion 316 for receiving a portion of air handler 308, and a transparent or semi-transparent front panel 320 covering a front opening 322 of basket 302. In one embodiment, a cooling plate 324 is removably positioned within storage compartment 304. A temperature sensor 330 or any suitable feedback device is positioned with respect to basket 302 for sensing the temperature within storage compartment 304. Temperature sensor 330 generates and transmits a signal indicative of the temperature sensed within storage compartment 304 to controller 123. When basket 302 is in a closed position, basket 302 is covered by a thermally insulated cover assembly 340 having a first cover 342 and a second cover 344 cooperatively forming an air duct 346 therebetween.

Figure 8:
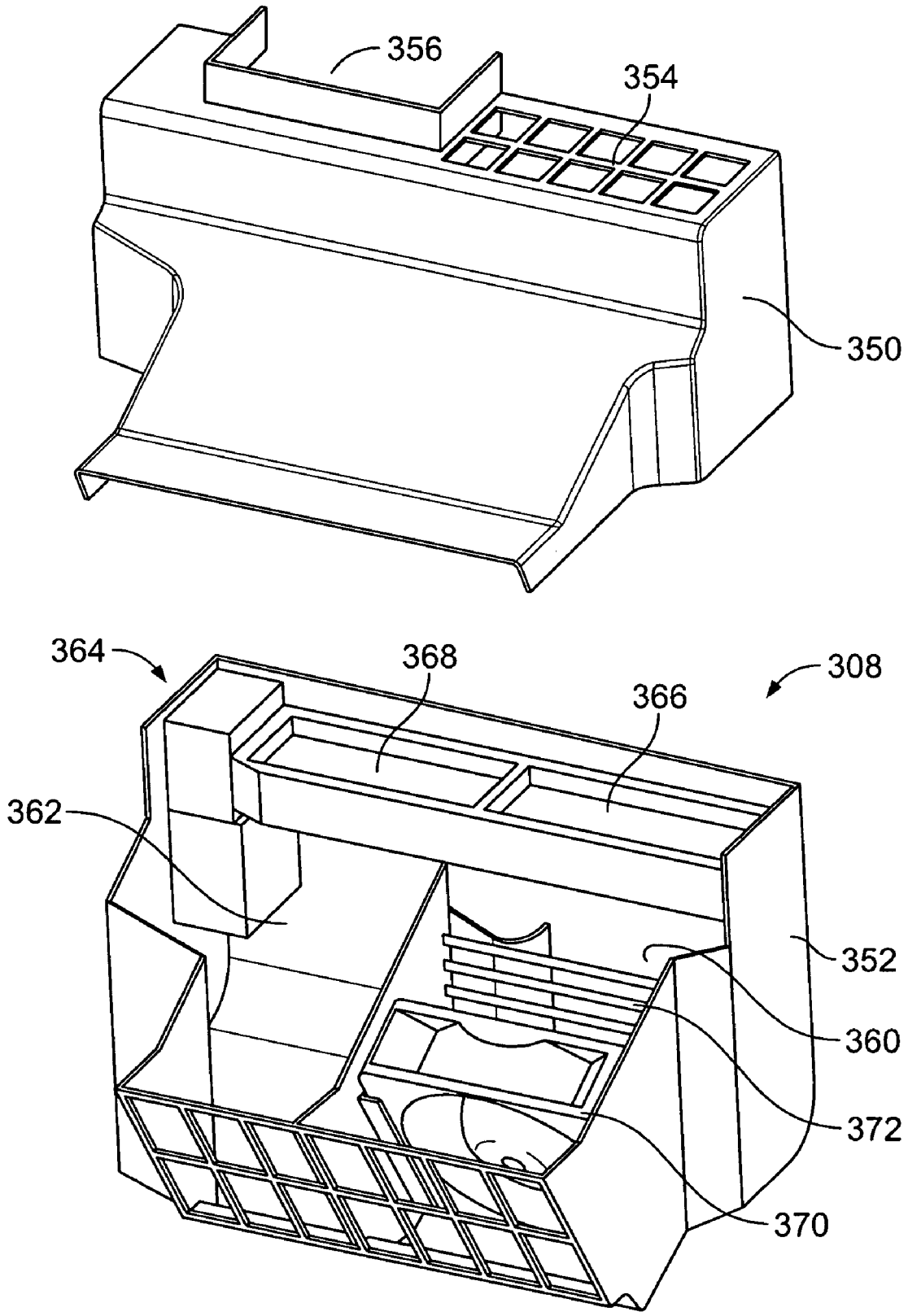
FIG. 8 is an exploded view of an exemplary air handler suitable for use with the storage assembly shown in FIG. 7.

FIG. 8 is an exploded view of air handler 308 suitable for use with storage assembly 300 shown in FIG. 7. Air handler 308 includes an air handler top portion 350 and an air handler bottom portion 352. Top portion 350 defines an air inlet 354 and an air outlet 356. Top portion 350 is coupled to air handler bottom 352 to define a first air conduit 360 and a second air conduit 362 therebetween. Air inlet 354 and air outlet 356 are coupled in flow communication with the evaporator (not shown) for creating a cool air flow path. Air conduits 360, 362 are aligned with corresponding air inlet 354 and air outlet 356, respectively. A damper 364 having a first door 366 and a second door 368 is positioned within air handler bottom 352. First door 366 and second door 368 control the air flow through corresponding air inlet 354 and air outlet 356, respectively. Air handler 308 also includes a fan 370 and a heater 372 positioned within first air conduit 360 and operatively coupled to controller 123 (shown in FIG. 1).

Figure 9:
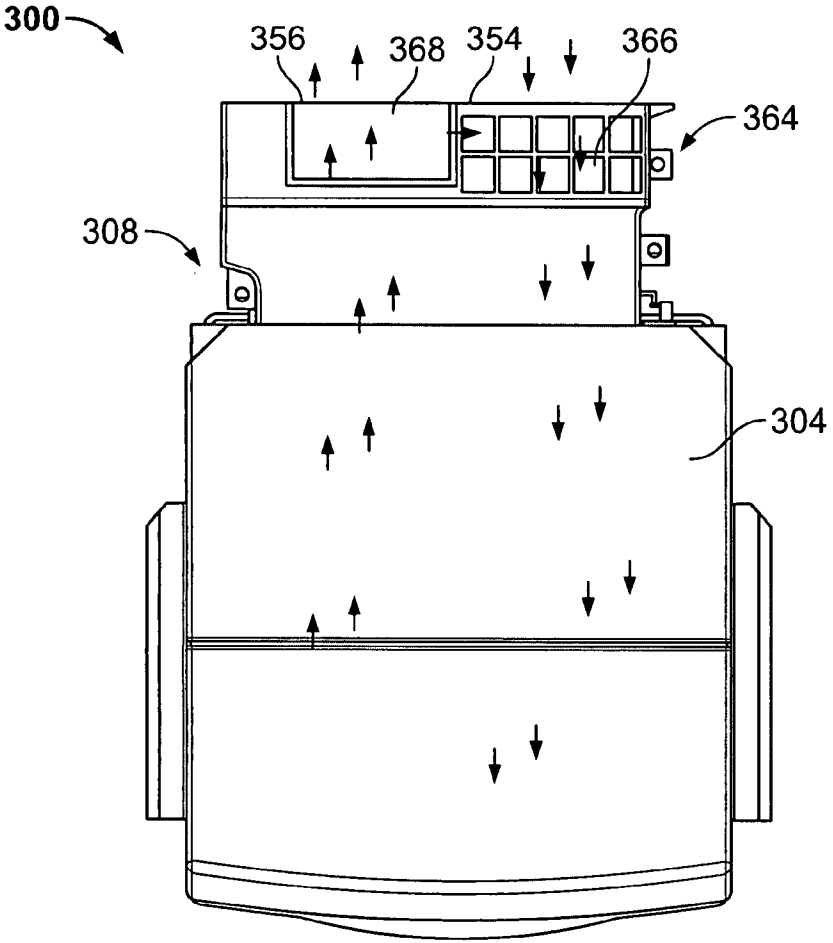
FIG. 9 shows an exemplary air flow path in a fast cooling mode for the storage assembly shown in FIG. 7.

FIG. 9 illustrates an exemplary air flow path in a fast cooling mode of storage assembly 300 shown in FIG. 7. During the fast cooling mode according to one embodiment, controller 123 (shown in FIG. 1) actuates damper 364 to open first door 366 and second door 368, and energizes fan 370 (shown in FIG. 8) to create or generate an air flow through storage compartment 304. In this embodiment, heater 372 is de-energized during the fast cooling mode.

Cool air flows from the evaporator into air inlet 354, through first door 366 of damper 364 and first air conduit 360 (shown in FIG. 8), and then into storage compartment 304. In one embodiment, fan 370 directs the cool air into storage compartment 304 at an increased velocity compared with that the cool air circulated through freezer storage compartment 104. The cool air flows across the food item(s) positioned within storage compartment 304, and flows back into air handler 308 through second air conduit 362 (shown in FIG. 8). The cool air then flows through second air conduit 362 and second door 368 of damper 364, and exits storage assembly 300 through air outlet 356. Controller 123 opens or closes first door 366 and/or second door 368, and energizes or de-energizes fan 370 to generate or prevent air flow when the temperature sensed by sensor 330 (shown in FIG. 7) below or above, respectively, a predetermined temperature. As such, controller 123 maintains storage compartment 304 at a temperature independent from the temperature within freezer storage compartment 104. In one embodiment, the temperature within storage compartment is below the temperature within freezer storage compartment 104.

Figure 10:
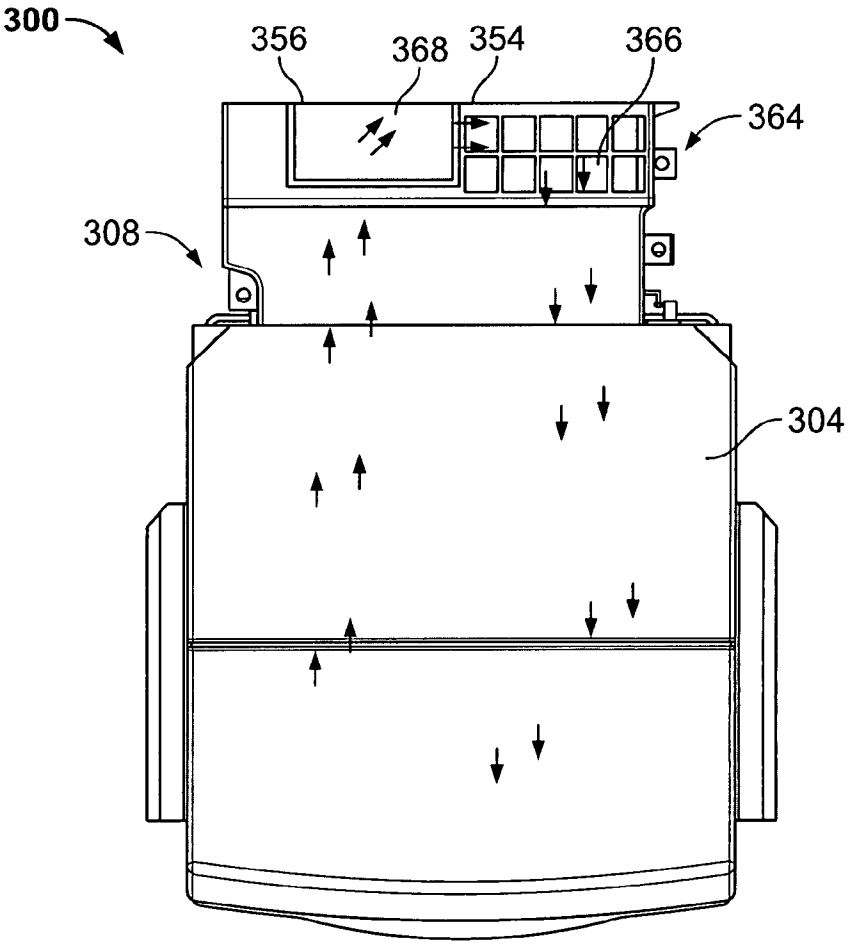
FIG. 10 shows an exemplary air flow path in a soft freeze mode for the storage assembly shown in FIG. 7.

FIG. 10 illustrates an exemplary air flow path in a soft freeze mode of storage assembly 300 shown in FIG. 7. During the soft freeze mode according to one embodiment, controller 123 (shown in FIG. 1) energizes heater 372 (shown in FIG. 8) and fan 370 (shown in FIG. 8) to heat the air within storage compartment 304. In this embodiment, controller 123 closes first door 366 and second door 368 of damper 364 during the soft freeze mode.

Cool air is prevented from flowing into air handler 308 when first door 366 and second door 368 are closed. Air within storage compartment 304 is drawn into second air conduit 362 by fan 370, and flows into first air conduit 360. The air is heated by heater 372 in first air conduit 360, and the heated air flows back through storage compartment 304. As such, an air flow path is established within storage assembly 300, and storage compartment 304 is maintained at a temperature above the temperature within freezer storage compartment 104 (shown in FIG. 1). Controller 123 energizes or de-energizes fan 370 and heater 372 when the sensed temperature below or above, respectively, a predetermined temperature.

In one embodiment, the storage compartment is provided within the freezer storage compartment, and is maintainable at a temperature independent from the temperature of the freezer storage compartment. As such, the user may store food items within the storage compartment at a selected temperature without adjusting the temperature of the entire freezer storage compartment. In a particular embodiment, the storage compartment is operated in a fast cooling mode and/or a soft freeze mode for facilitating food preservation and/or operation convenience.

While the invention has been described in terms of various specific embodiments, those skilled in the art will recognize that the invention can be practiced with modification within the spirit and scope of the claims.

What is claimed is:

1. A storage assembly for a refrigerator including a freezer storage compartment, said storage assembly comprising:

a storage compartment having a first end and positioned within the freezer storage compartment, the freezer storage compartment comprising a sealed system configured to refrigerate the freezer storage compartment, the sealed system comprising at least one first fan;

a cooling plate positioned within said storage compartment and configured to support a food item, said cooling plate configured to transfer thermal energy between the food item and said cooling plate through conduction; and a dedicated second fan positioned at said first end of said storage compartment and configured to draw cool air into said storage compartment and direct the cool air across the food item.

2. A storage assembly in accordance with claim 1 wherein said second fan is configured to channel cool air into said storage compartment at an increased velocity.

3. A storage assembly in accordance with claim 1 further comprising a feedback device positioned with respect to said storage compartment, said feedback device configured to maintain a temperature within said storage compartment independently from a temperature within the freezer storage compartment.

4. A storage assembly in accordance with claim 3 wherein said feedback device comprises a temperature sensor positioned with respect to said storage compartment, said temperature sensor configured to detect the temperature within said storage compartment.

5. A storage assembly in accordance with claim 1 further comprising a heater configured to heat air within said storage compartment.

6. A storage assembly in accordance with claim 1 further comprising a damper configured to control air flow through said storage compartment.

7. A storage assembly in accordance with claim 1 wherein said cooling plate comprises a thermally conductive material.

8. A refrigerator comprising:

a freezer storage compartment having a first temperature, said freezer storage compartment comprising a sealed system configured to refrigerate said freezer storage compartment, said sealed system comprising at least one first fan; and a storage assembly mounted within said freezer storage compartment, said storage assembly comprising:

a second storage compartment;

a dedicated second fan positioned at a first end of said second storage compartment and configured to direct cool air into said second storage compartment; and a temperature sensor positioned with respect to said second storage compartment and configured to detect a temperature within said second storage compartment; and a controller operatively coupled to said temperature sensor, said controller configured to maintain a temperature within said second storage compartment at a second temperature independent from the first temperature within said freezer storage compartment.

9. A refrigerator in accordance with claim 8 wherein said second storage compartment is substantially thermally isolated from said freezer storage compartment.

10. A refrigerator in accordance with claim 8 wherein said storage assembly comprises a cooling plate positioned within said second storage compartment and configured to facilitate cooling a food item supported on said cooling plate.

11. A refrigerator in accordance with claim 10 wherein said cooling plate is configured to transfer thermal energy between the food item and said cooling plate through conduction.

12. A refrigerator in accordance with claim 8 wherein said storage assembly further comprises a heater positioned within said second storage compartment and configured to heat the air within said second storage compartment.

13. A refrigerator in accordance with claim 8 wherein said storage assembly further comprises a damper controlling air flow through said second storage compartment.

14. A refrigerator in accordance with claim 13 further comprising an air conduit coupled in flow communication with said damper and configured to supply cool air to said damper.

15. A method for freezing a food item within a refrigerator, said method comprising:

providing a freezer storage compartment having a first temperature, the freezer storage compartment comprising a sealed system configured to refrigerate the freezer storage compartment, the sealed system comprising at least one first fan;

positioning a storage assembly within the freezer storage compartment, the storage assembly comprising a second storage compartment having a first end, a dedicated second fan positioned at the first end of the second storage compartment and configured to direct cool air into the second storage compartment, and a temperature sensor positioned with respect to the second storage compartment, the sensor configured to detect a temperature within the second storage compartment; and operatively coupling a controller to the temperature sensor, the controller configured to maintain a second temperature within the second storage compartment independent from the first temperature within the freezer storage compartment.

16. A method in accordance with claim 15 further comprising substantially thermally insulating the second storage compartment from the freezer storage compartment.

17. A method in accordance with claim 15 further comprising positioning a metal plate within the second storage compartment, said metal plate configured to facilitate cooling a food item supported on the metal plate.

18. A method in accordance with claim 17 wherein said positioning a metal plate comprises positioning a metal plate configured to transfer thermal energy between the food item and the metal plate through conduction.

19. A method in accordance with claim 15 further comprising positioning a heater within the second storage compartment, the heater configured to heat the air within the second storage compartment.

20. A method in accordance with claim 15 further comprising coupling a damper in flow communication with the second storage compartment such that the damper controls air flow into the second storage compartment.

* * * * *